US012736306B2

(12) United States Patent
Havens et al.

(10) Patent No.: US 12,736,306 B2
(45) Date of Patent: Sep. 15, 2026

(54) PROTECTIVE COVER FOR AN OPTIC DEVICE

(71) Applicant: Sheltered Wings, Inc., Barneveld, WI (US)

(72) Inventors: Calen Havens, Barneveld, WI (US); William Lowry, Barneveld, WI (US); Sam Hamilton, Barneveld, WI (US); Ian Klemm, Barneveld, WI (US); Tom Cody, Barneveld, WI (US); Garrison Bollig, Barneveld, WI (US); Cory Taylor, Barneveld, WI (US); Tim Rue, Barneveld, WI (US); Alexander Lewis, Barneveld, WI (US); Tony Palzkill, Barneveld, WI (US); Zach Sausen, Barneveld, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 312 days.

(21) Appl. No.: 18/355,773

(22) Filed: Jul. 20, 2023

(65) Prior Publication Data

US 2024/0027168 A1 Jan. 25, 2024

Related U.S. Application Data

(60) Provisional application No. 63/391,029, filed on Jul. 21, 2022.

(51) Int. Cl.
*F41G 1/38* (2006.01)

(52) U.S. Cl.
CPC ..... *F41G 1/383* (2013.01)

(58) Field of Classification Search
CPC ..... G02B 23/00; G02B 23/12; G02B 23/14; G02B 23/16; G02B 27/00; G02B 27/0006; F41G 1/383; F41G 1/00; F41G 1/38
USPC ..... 359/511, 362, 363, 399, 400, 423, 424, 359/428, 434, 507, 513; 42/90, 111, 119, 42/122, 129, 130, 143
See application file for complete search history.

(56) References Cited

U.S. PATENT DOCUMENTS 6,318,864 B1 * 11/2001 Fukaya ..... A61B 46/10 359/368
2005/0128593 A1 6/2005 Benner
2015/0168103 A1 * 6/2015 Ilacqua ..... F41G 1/383 42/143
2017/0176142 A1 6/2017 Zhang et al.
(Continued)

FOREIGN PATENT DOCUMENTS

EP 1992911 A2 11/2008
JP 2023047274 A * 4/2023 ..... G02B 27/0006

OTHER PUBLICATIONS

International Preliminary Report on Patentability for corresponding International Application No. PCT/US2023/070619, mailed Jan. 30, 2025, 8 pages.
(Continued)

*Primary Examiner* — Arnel C Lavarias
(74) *Attorney, Agent, or Firm* — Husch Blackwell LLP

(57) ABSTRACT

Viewing optics, and more particularly a protective cover for a viewing optic is disclosed herein. In one embodiment, a cover including a frame with one or more holes configured to slide over one or more mounting studs, a connector coupling the frame to a protective material, the protective material configured to cover a viewing window is disclosed.

14 Claims, 11 Drawing Sheets

(56) References Cited

U.S. PATENT DOCUMENTS

| | | | | |
|---|---|---|---|---|
| 2017/0285334 | A1 | 10/2017 | Meade | |
| 2018/0194328 | A1* | 7/2018 | Numakunai ..... | G03B 17/02 |
| 2022/0179226 | A1 | 6/2022 | Hamilton et al. | |

OTHER PUBLICATIONS

International Search Report and Written Opinion for International Application No. PCT/US2023/070619 issued on Aug. 14, 2024, 12 pages.

* cited by examiner

PROTECTIVE COVER FOR AN OPTIC DEVICE

CROSS-REFERENCE TO RELATED APPLICATIONS

This Application is a non-provisional application of and claims priority to U.S. Provisional Patent Application Ser. No. 63/391,029 filed Jul. 21, 2022, which is incorporated herein by reference in its entirety.

FIELD

The disclosure relates to viewing optics, and more particularly to a protective cover for a viewing optic. In one embodiment, the disclosure relates to a cover for a non-circular window of a viewing optic.

BACKGROUND

Riflescope lenses are oftentimes subject to the environmental elements, which can cause dirt and grime to cover the lens, or worse, can cause damage to the lens. Protective caps exist to protect against these issues. Moreover, these protective caps can be easily kept on the riflescope, as they are oftentimes stored on the optic. Additionally, users of riflescopes have used alignment apertures (otherwise known as parallax reducing aperture stops, aperture caps, or aperture limiters) in conjunction with their riflescopes. Aperture caps can be used to align the riflescope and prevent parallax (i.e., displacement of an object due to error in the lens). These aperture caps, however, have been primarily used for indoor dryfire training.

Although there are protective caps and aperture caps, there are no caps that achieve the functions and purposes of both. These caps have been developed as separate components, requiring users to keep track of both caps. Issues arise when these caps are separate components, as it is easier for users to lose one or both of these caps. Additionally, even if the caps are not lost, there is an added stress for the users to manage more items while using their riflescopes.

Ultimately, if a user is unable to keep track of both caps, or if a user believes it is too difficult to keep both, the individual will decide to use the riflescope without an aperture cap. The user will not be able to perform alignment without the aperture cap. Without the alignment aperture, users will experience further issues with parallax, which will lead to decreased precision in aiming and impact while using the riflescope.

In addition, enablers, such as a laser rangefinder, often have windows and surfaces that need to be protected. However, often times, enablers have non-circular windows and surfaces.

Accordingly, the need exists for a protective cap for a non-circular optic that can be installed and removed without the use of tools.

SUMMARY

In one embodiment, the disclosure relates to a cover for a non-circular optic. In one embodiment, the disclosure relates to a cover or protective cap for a non-circular viewing window. In one embodiment, the cover or protective cap can be installed and removed without the use of tools.

In one embodiment, the cover comprise a frame configured to fit around the window frame of a viewing optic. In another embodiment, the cover comprises a protective material configured to fit over the window of a viewing optic. In another embodiment, the cover further comprises a connector coupling the frame to the protective material.

In one embodiment, the disclosure relates to a protective device for a non-circular optic. In one embodiment, the disclosure relates to a protective device for a non-circular viewing window. In one embodiment, the protective device can be installed and removed without the use of tools.

In one embodiment, the protective device comprise a frame configured to fit around the window frame of a viewing optic. In another embodiment, the protective device comprises a protective material configured to fit over the window of a viewing optic. In another embodiment, the protective device further comprises a connector coupling the frame to the protective material.

In one embodiment, the disclosure relates to a system comprising: an enabler for a viewing optic, the enabler having a window and a window frame that surrounds at least a portion of the window, the window frame having one or more mounting studs, and a cover having a frame with one or more holes configured to slide over the one or more mounting studs of the window frame and a protective material that can cover the window of the enabler. In one embodiment, a connector couples the frame to the protective material.

In one embodiment, the disclosure relates to a system comprising: an enabler for a viewing optic, the enabler having a window and a window frame that surrounds at least a portion of the window, the window frame having one or more mounting studs, and a protective device having a frame with one or more holes configured to slide over the one or more mounting studs of the window frame and a protective material or protective component that can cover the window of the enabler. In one embodiment, the protective device further comprises a connector that couples the frame to the protective material.

In one embodiment, the disclosure relates to a system comprising: a device, the device having a viewing window and a window frame that surrounds at least a portion of the viewing window, the window frame having one or more mounting studs, and a cover having a frame with one or more holes configured to slide over the one or more mounting studs of the window frame and a protective material that can cover the viewing window of the device. In one embodiment, a connector couples the frame to the protective material.

In one embodiment, the disclosure relates to a system comprising: an optic, the optic having a viewing window and a window frame that surrounds at least a portion of the viewing window, the window frame having one or more mounting studs, and a cover having a frame with one or more holes configured to slide over the one or more mounting studs of the window frame and a protective material that can cover the viewing window of the optic. In one embodiment, a connector couples the frame to the protective material.

In one embodiment, the window frame has 4 or 6 or 8 mounting studs. In another embodiment, the window frame has an even number of mounting studs. In one embodiment, the window frame has 6 mounting studs.

In one embodiment, the cover or protective device is made of malleable material. In another embodiment, the cover is made of a pliable material. In one embodiment, the protective material is configured to fit the window frame of the enabler.

In one embodiment, the protective material or protective component is made of malleable material. In another embodiment, the protective material is made of a pliable material.

In one embodiment, the one or more mounting studs have a 60° tapered head on the front of the stud. In another embodiment, the one or more mounting studs have a shelf at the rear of the stud. The shelf is a structure configured to hold the protective cover.

In one embodiment, the enabler is a laser rangefinder.

In another embodiment, the system further comprises a viewing optic having a main body with an objective lens system at one end of the main body and an ocular lens system located at the other end of the main body, an enabler coupled to a top portion of the main body, the enabler having a viewing window, and a cover or protective device for the viewing window of the enabler.

In one embodiment, the viewing optic comprises an active display configured to generate an image. In another embodiment, the generated image is projected into a first focal plane of the viewing optic, the first focal plane located between the objective lens system and an erector lens system.

In one embodiment, the disclosure relates to a cover comprising: a frame with one or more holes configured to slide over one or more mounting studs of an enabler, a connector coupling the frame or structure to a protective material that can cover a viewing window of the enabler.

In one embodiment, the frame is made of pliable material. In another embodiment, the frame has 6 holes.

In one embodiment, the disclosure relates to an enabler comprising: a viewing window and a window frame that surrounds at least a portion of the viewing window, the window frame having one or more mounting studs. In one embodiment, the one or more mounting studs have a tapered head on the front of the stud. In another embodiment, the one or more mounting studs have a shelf at the rear of the stud.

In one embodiment, the disclosure relates to system comprising a cover or protective device for a non-circular optic and a "zero cap" for a viewing optic.

In one embodiment, the disclosure relates to system comprising a cover or protective device for a viewing window of an enabler and a "zero cap" for a viewing optic.

In one embodiment, the disclosure relates to a "zero cap," which alleviates the issues related to keeping track of two separate caps. As disclosed herein, a zero cap serves as both a protective cap and an aperture cap. In one embodiment, a zero cap can be attached to a viewing optic. A zero cap with multiple functionalities, but as one component, prevents the user from having to manage several components and potentially losing these components.

Not only is there increased ease of use with the zero cap disclosed herein, but there is also increased accuracy for users. Users can easily have the alignment aperture connected to their viewing optic and can easily calibrate their optic. This leads to increased accuracy and decreased frustrations when using the viewing optic.

Additionally, the lens of the viewing optic is kept clean because of the zero cap. Typically, debris and dirt get into the viewing optic. Although a user can have a protective cap, they are not able to have a protective cap and alignment aperture in one cap. Having a single cap to serve both functions increases accuracy, decreases frustration, prevents misplacement and loss, and reduces messes on the lens.

In one embodiment, the disclosure relates to a zero cap comprising: a base; an aperture cap configured to hingedly connect to the base; and a cap plug configured to rotate on the aperture cap. In one embodiment, the base comprises a first opening and a first connective mechanism. In another embodiment, the first opening is configured to attach to a viewing optic; and the first connective mechanism is configured to receive a pin to connect the first connective mechanism to other connective mechanisms.

In one embodiment, the aperture cap comprises a plurality of holes and a second connective mechanism. The aperture cap can have two or more holes. In one embodiment, the plurality of holes are each configured to receive one of a plurality of plugs. In another embodiment, the second connective mechanism is configured to receive a pin to connect it to other connective mechanisms.

In one embodiment, the cap plug comprises a first plug and a second plug.

In one embodiment, the disclosure relates to a zero cap comprising: a base configured to connect to a viewing optic; an aperture cap configured to hingedly connect to the base and having a first hole and a second hole; wherein the second hole is located below the first hole; and a cap plug having a first plug and a second plug, wherein the first plug is configured to interact with the first hole and the second plug is configured to interact with the second hole.

In one embodiment, the base has an opening configured to attach an outer connecting strip of a viewing optic.

In one embodiment, the first hole of the aperture cap is at the center of the aperture cap.

In one embodiment, the disclosure relates to a viewing optic comprising a zero cap as disclosed herein. In yet another embodiment, the disclosure relates to a riflescope comprising a zero cap disclosed herein.

In one embodiment, the disclosure relates to a viewing optic comprising a zero cap having a base, an aperture cap configured to hingedly connect to the base; and a cap plug configured to rotate on the aperture cap; and a connecting strip configured to interact with the base.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings.

Figure 1:
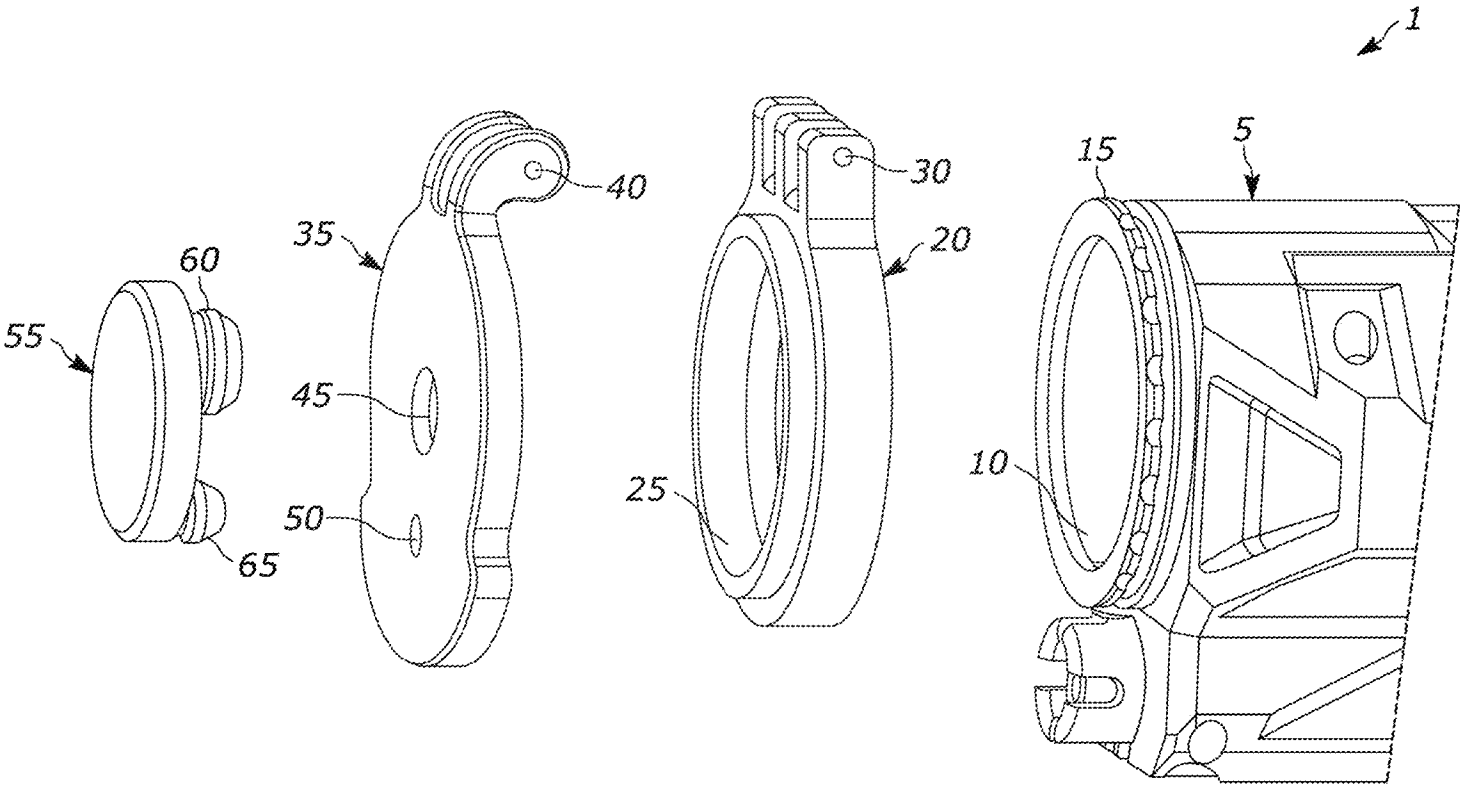
FIG. 1 is an exploded view of a detached zero cap in an environment with a viewing optic.

Before explaining embodiments of the disclosure in detail, it is to be understood that the disclosure is not limited in its application to the details of construction and the arrangement of the components set forth in the following description or illustrated in the drawings. The technology of this disclosure is capable of other embodiments or being practiced or carried out in various ways. Also, it is to be understood that the phraseology and terminology employed herein is for the purpose of description and should not be regarded as limiting.

DETAILED DESCRIPTION

The disclosure relates to covers for viewing optics and related devices. Certain preferred and illustrative embodiments of the invention are described below. The present invention is not limited to these embodiments.

The apparatuses and methods disclosed herein will now be described more fully hereinafter with reference to the accompanying drawings, in which embodiments of the disclosure are shown. The apparatuses and methods disclosed herein may, however, be embodied in many different forms and should not be construed as limited to the embodiments set forth herein. Rather, these embodiments are provided so that the disclosure will be thorough and complete and will fully convey the scope of the invention to those skilled in the art.

It will be appreciated by those skilled in the art that the set of features and/or capabilities may be readily adapted within the context of a standalone weapons sight, front-mount or rear-mount clip-on weapons sight, and other permutations of filed deployed optical weapons sights. Further, it will be appreciated by those skilled in the art that various combinations of features and capabilities may be incorporated into add-on modules for retrofitting existing fixed or variable weapons sights of any variety.

It will be understood that when an element or layer is referred to as being "on," "connected to" or "coupled to" another element or layer, it can be directly on, connected or coupled to the other element or layer. Alternatively, intervening elements or layers may be present. In contrast, when an element is referred to as being "directly on," "directly connected to" or "directly coupled to" another element or layer, there are no intervening elements or layers present.

Like numbers refer to like elements throughout. As used herein, the term "and/or" includes any and all combinations of one or more of the associated listed items.

It will be understood that, although the terms first, second, etc. may be used herein to describe various elements, components, regions, and/or sections, these elements, components, regions, and/or sections should not be limited by these terms. These terms are only used to distinguish one element, component, region, or section from another element, component, region, or section. Thus, a first element, component, region, or section discussed below could be termed a second element, component, region, or section without departing from the disclosure.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

DEFINITIONS

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, viscosity, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, distances from a user of a device to a target.

The term "and/or" as used in a phrase such as "A and/or B" herein is intended to include both A and B; A or B; A (alone); and B (alone) Likewise, the term "and/or" as used in a phrase such as "A, B, and/or C" is intended to encompass each of the following embodiments: A, B, and C; A, B, or C; A or C; A or B; B or C; A and C; A and B; B and C; A (alone); B (alone); and C (alone).

As used herein, "ballistics" is a way to precisely calculate the trajectory of a bullet based on a host of factors.

As used herein, an enabler is a system or device that can be used with one or more viewing optics. In one embodiment, an enabler is a system or device that can provide information that aids the user of a viewing optic. In one embodiment, an enabler is a system or device that can couple to a portion of a viewing optic. In one embodiment, an enabler includes but is not limited to laser rangefinder, a camera, a compass module, a communication module, a laser aiming unit, an illuminator, a back-up sight (iron sights, red dots, or another sight), a pivoting sighting modules, or other devices useful to the user. As used herein, the terms "enabler" and "enabler device" are used interchangeably.

As used herein, an "erector sleeve" is a protrusion from the erector lens mount which engages a slot in the erector tube and/or cam tube or which serves an analogous purpose. This could be integral to the mount or detachable.

As used herein, an "erector tube" is any structure or device having an opening to receive an erector lens mount.

As used herein, the term "frame" refers to a structure that surrounds or encloses another component or structure. In one embodiment, the frame can surround or enclose a viewing window.

As used herein, the term "firearm" refers to any device that propels an object or projectile, for example, in a controllable flat fire, line of sight, or line of departure, for example, handguns, pistols, rifles, shotgun slug guns, muzzleloader rifles, single shot rifles, semi-automatic rifles and fully automatic rifles of any caliber direction through any media. As used herein, the term "firearm" also refers to a remote, servo-controlled firearm wherein the firearm has auto-sensing of both position and directional barrel orientation. The shooter is able to position the firearm in one location, and move to a second location for target image acquisition and aiming. As used herein, the term "firearm" also refers to chain guns, belt-feed guns, machine guns, and Gattling guns. As used herein, the term firearm also refers to high elevation, and over-the-horizon, projectile propulsion devices, for example, artillery, mortars, canons, tank canons or rail guns of any caliber.

As used herein, the term "malleable" refers to the ability to be formed into a variety of shapes and having flexible characteristics.

As used herein, the term "pliable" refers to ability to be bent or molded, flexible.

As used herein, a "reticle," in one embodiment, is an aiming pattern for a viewing optic, such as, but not limited to, a crosshair aiming point or other aiming pattern.

As used herein, the term "viewing optic" refers to an apparatus used by a shooter or a spotter to select, identify or monitor a target. The "viewing optic" may rely on visual observation of the target, or, for example, on infrared (IR), ultraviolet (UV), radar, thermal, microwave, or magnetic imaging, radiation including X-ray, gamma ray, isotope and particle radiation, night vision, vibrational receptors including ultra-sound, sound pulse, sonar, seismic vibrations, magnetic resonance, gravitational receptors, broadcast frequencies including radio wave, television and cellular receptors, or other image of the target. The image of the target presented to the shooter by the "viewing optic" device may be unaltered, or it may be enhanced, for example, by magnification, amplification, subtraction, superimposition, filtration, stabilization, template matching, or other means. The target selected, identified or monitored by the "viewing optic" may be within the line of sight of the shooter, or tangential to the sight of the shooter, or the shooter's line of sight may be obstructed while the target acquisition device presents a focused image of the target to the shooter. The image of the target acquired by the "viewing optic" may be, for example, analog or digital, and shared, stored, archived, or transmitted within a network of one or more shooters and spotters by, for example, video, physical cable or wire, IR, radio wave, cellular connections, laser pulse, optical, 802.11b or other wireless transmission using, for example, protocols such as html, SML, SOAP, X.25, SNA, etc., Bluetooth™, Serial, USB or other suitable image distribution method. The term "viewing optic" is used interchangeably with "optic sight."

As used herein, the term "outward scene" refers to a real world scene, including but not limited to a target.

As used herein, the term "shooter" applies to either the operator making the shot or an individual observing the shot in collaboration with the operator making the shot.

It is crucial to understand the purpose and functionality of alignment apertures to further understand the disclosure. A reticle is used to assist a shooter in hitting a target. A reticle can be made of various materials, including optical materials like optical glass or plastic. The reticle can be made of any transparent or translucent material. In one embodiment, the reticle is constructed from wire, spider web, nano-wires, etching, or printing. The reticle can also be constructed using a projection from a minor, video, holographic projection, or other means onto a material. The etching may be filled with a reflective material that illuminates when a light is rheostatically switching to increase or decrease light intensity. The reticle can be mounted anywhere between an ocular lens and objective lens of a scope lens. There are two critical calibration functions to perform mounting a riflescope.

In one embodiment, the reticle can be an electronic reticle from an active display that is projected into a first focal plane of a viewing optic. The first focal plane is located between the objective lens system and the erector lens system. The second focal plane is located between the ocular lens system and the erector lens system.

The two critical calibration functions include zeroing the weapon and laser range finder alignment. First, zeroing the weapon commonly refers to the process of aligning the etched (passive) reticle with the weapon's point of impact when firing at a target. Second, aligning the integrated laser range finder (LRF) is accomplished with the use of an alignment chart. The alignment chart details the location of the LRF's co-aligned visible laser with respect to the passive reticle. For illustrative purposes, imagine a user is attempting to use a riflescope and needs to align the LRF. The user places the alignment chart at a predetermined distance from an observation point. The user then aims the weapon, optic, and passive reticle at the specified point. The user then adjusts the LRF's visible laser to align with the related point on the alignment chart.

The steps included in the calibration functions may seem straightforward, but even those highly trained and experienced can face issues arising from parallax. As described above, parallax is displacement of an object due to error in the lens. However, this issue can be addressed by using an aperture cap attached to the front of the riflescope. The aperture cap restricts the aperture diameter, ultimately reducing error. Zeroing the weapon can be completed at 25 meters. Aligning the LRF to the passive and active reticles can be completed at 10 meters.

As stated above, the zero cap disclosed herein is a combined protective cap and aperture cap. This eliminates the difficulty and stress of managing multiple caps and keeping track of various pieces while using a riflescope. The protective cap is typically attached to a riflescope, and the zero cap can be similarly attached.

In one embodiment, the zero cap is capable of being used as an aperture cap when the protective cap is closed and the cap plug is detached at one end to be rotated out of the optical path. The user can then look through the hole in the center (where the cap plug has been rotated away); in this example, the user is looking through a restricted objective aperture.

The cap plug features two plugs that are each made to attach to holes in the aperture cap. When the top plug is in the top hole on the aperture cap, the zero cap is capable of being used for protection, as both holes are plugged and debris is prevented from entering. When the top plug is rotated around and not in the top hole on the aperture cap, the zero cap is capable of being used for zeroing and laser range finder alignment. To keep the cap plug from falling off the aperture cap, when the zero cap is being used for protection or calibration, the bottom plug remains in the bottom hole on the aperture cap. This prevents the cap plug from being misplaced or lost.

The zero cap can be used in various different capacities, but the following are a few representative examples. A zero cap can be used on an LRF mounted to the scope's passive reticle, as long as the LRF has a co-aligned visible laser and the user has the correct alignment card for the riflescope and LRF combination. The zero cap can be used for dryfire training indoors. The zero cap also can be used for zeroing a weapon with a conventional riflescope or a magnified optic for between 10 and 100 meters.

FIG. 1 illustrates an exploded view of components of a zero cap in an environment 1. The zero cap comprise several components: a base 20, an aperture cap 35, and cap plug 55. In one embodiment, the zero cap attaches to a riflescope. The riflescope 5 comprises an opening 10 and an outer connecting strip 15.

In one embodiment, the outer connecting strip 15 is a protruding rim on the riflescope 5. The outer connecting strip 15 is designed to mechanically interface with a cap, which in one embodiment is a zero cap. The outer connecting strip 15 is preferably capable of attaching to the base 20 of a zero cap. The base 20 has an opening 25, which is configured to attach to the outer connecting strip 15 in a manner known in the art. The base 20 has a connective mechanism 30 with a hole designed to receive a hinge pin (not illustrated) for connecting it to another connective mechanism.

In one embodiment, the connective mechanism 30 is connected to an aperture cap 35. The aperture cap 35 has a connective mechanism 40 with a hole designed to receive a hinge pin (not illustrated) for connection. In one embodiment, a hinge pin can be placed first through the connective mechanism 30 of the base 20 and then through the connective mechanism 40 of the aperture cap 35 and out through the other side of the connective mechanisms. This hinge pin keeps the two pieces (the base 20 and the aperture cap 35) connected, while also allowing the aperture cap 35 to hinge about the base 20.

In one embodiment, the aperture cap 35 has two holes on its face. In one embodiment, the top hole 45 is placed in the center of the face of the aperture cap 35. The bottom hole 50 is preferably placed off center of the face of the aperture cap 35 below the top hole 45.

The top hole 45 and bottom hole 50 are designed to each receive a plug. In one embodiment, the top hole 45 and bottom hole 50 receive plugs from a cap plug 55. The cap plug 55 has two plugs (a top plug 60 and a bottom plug 65). The top plug 60 is designed to be placed in the top hole 45, while the bottom plug 65 is designed to be placed in the bottom hole 50. The bottom plug 65 is designed to remain in the bottom hole 50.

In one embodiment, the bottom plug 65 is capable of being rotated around within the bottom hole 50. This rotation allows the top plug 60 to be removed from the top hole 45 and stay out of the way of the aperture cap opening for alignment to take place. The top plug 60 is capable of being removed from the top hole 45 in order to be moved about the aperture cap 35. This movement creates a full line of sight for the user through the top hole 45. The top plug 60 is designed to be removed from the top hole 45 while the bottom plug 65 remains within the bottom hole 50.

In one embodiment, the aperture cap has at least two holes on its face.

Figure 2:
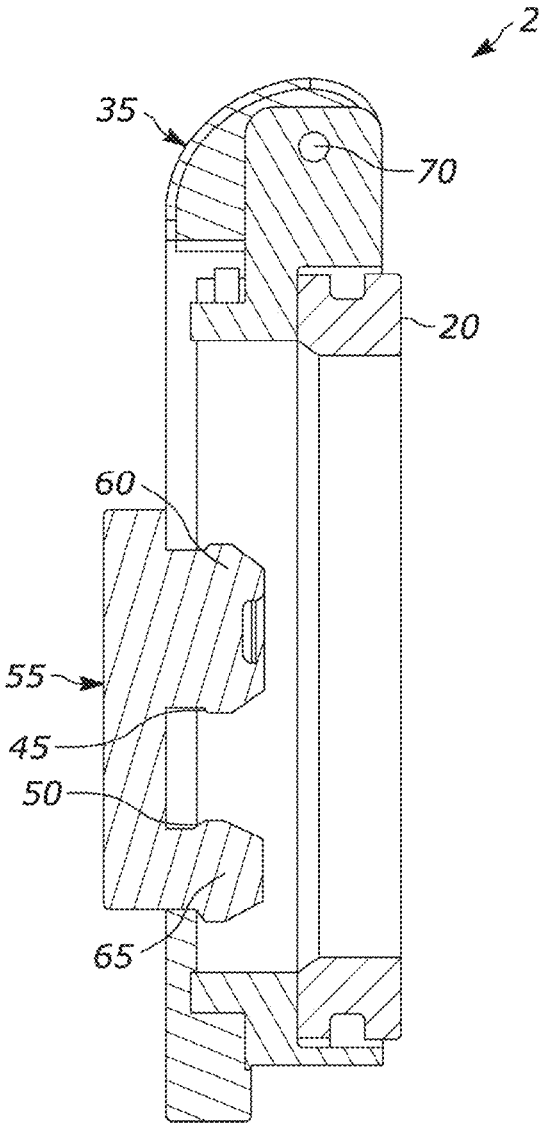
FIG. 2 is a side view of a fully connected zero cap disclosed herein.

FIG. 2 illustrates a side view of a fully connected zero cap 2. The zero cap 2 comprises the base 20, the aperture cap 35, and the cap plug 55. The base 20 and the aperture cap 35 are connected via a hinge pin 70. As shown, the top plug 60 and bottom plug 65 of the cap plug 55 are fully integrated with the top hole 45 and bottom hole 50 of the aperture cap 35, respectively. The plugs are connected in such a way as to eliminate access of debris inside the zero cap 2.

Figure 3:
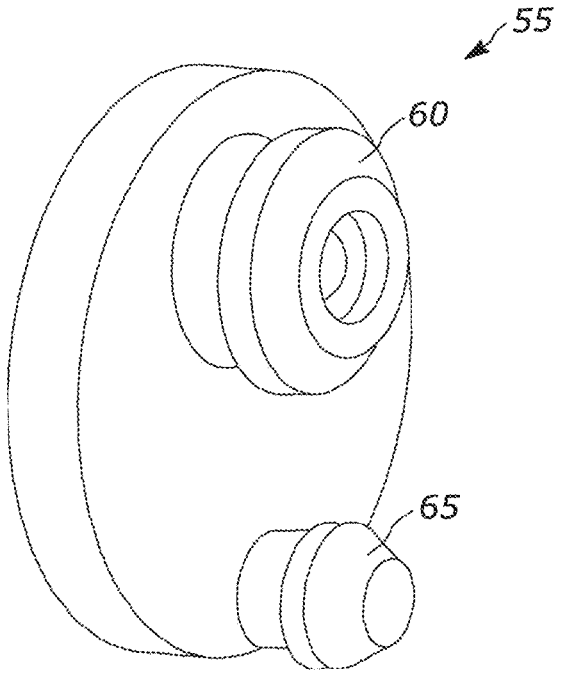
FIG. 3 is a representative depicture of a cap plug as disclosed herein.

FIG. 3 illustrates a side perspective of the cap plug 55. As shown, the top plug 60 is configured to allow the top plug 60 to be removed from the top hole 45 (as discussed above) while the cap plug 55 remains connected to the aperture cap 35. The bottom plug 65 is designed to remain in the bottom hole 50 (as discussed above), even while the top plug 60 is disconnected. This is preferable, as the cap plug 55 does not need to be removed from the aperture cap 35. The cap plug 55 can remain connected to the zero cap 2 as a whole, preventing misplacement or loss of the cap plug 55.

Figure 4:
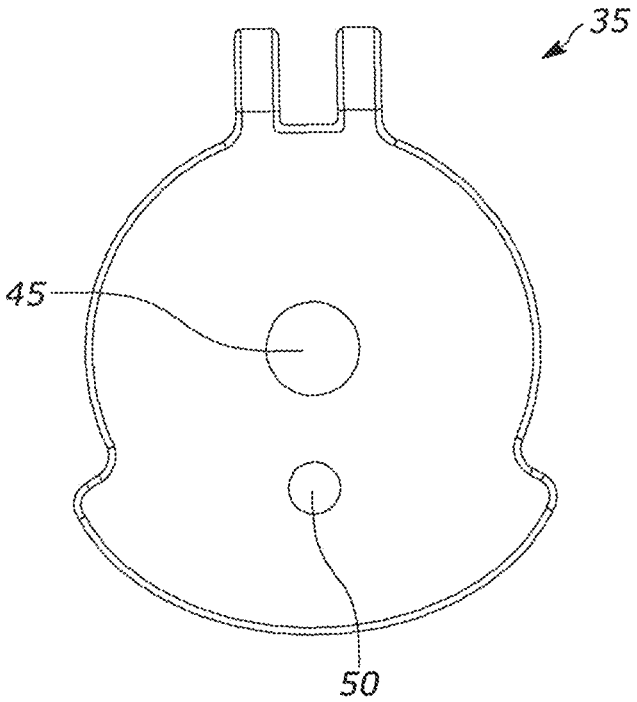
FIG. 4 is a representative depiction of an aperture cap as disclosed herein.

FIG. 4 illustrates a front view of the aperture cap 35. The aperture cap 35 preferably has a top hole 45 and a bottom hole 50. In one embodiment, the top hole 45 is positioned at the optical center of the riflescope concentric to the objective lens. The bottom hole 50 is preferably positioned below the top hole 45. In one embodiment, the bottom hole 50 serves as an interface with the cap plug 55 (as discussed above) and remains connected to the bottom plug 65 even when the top hole 45 is left open.

Figure 5:
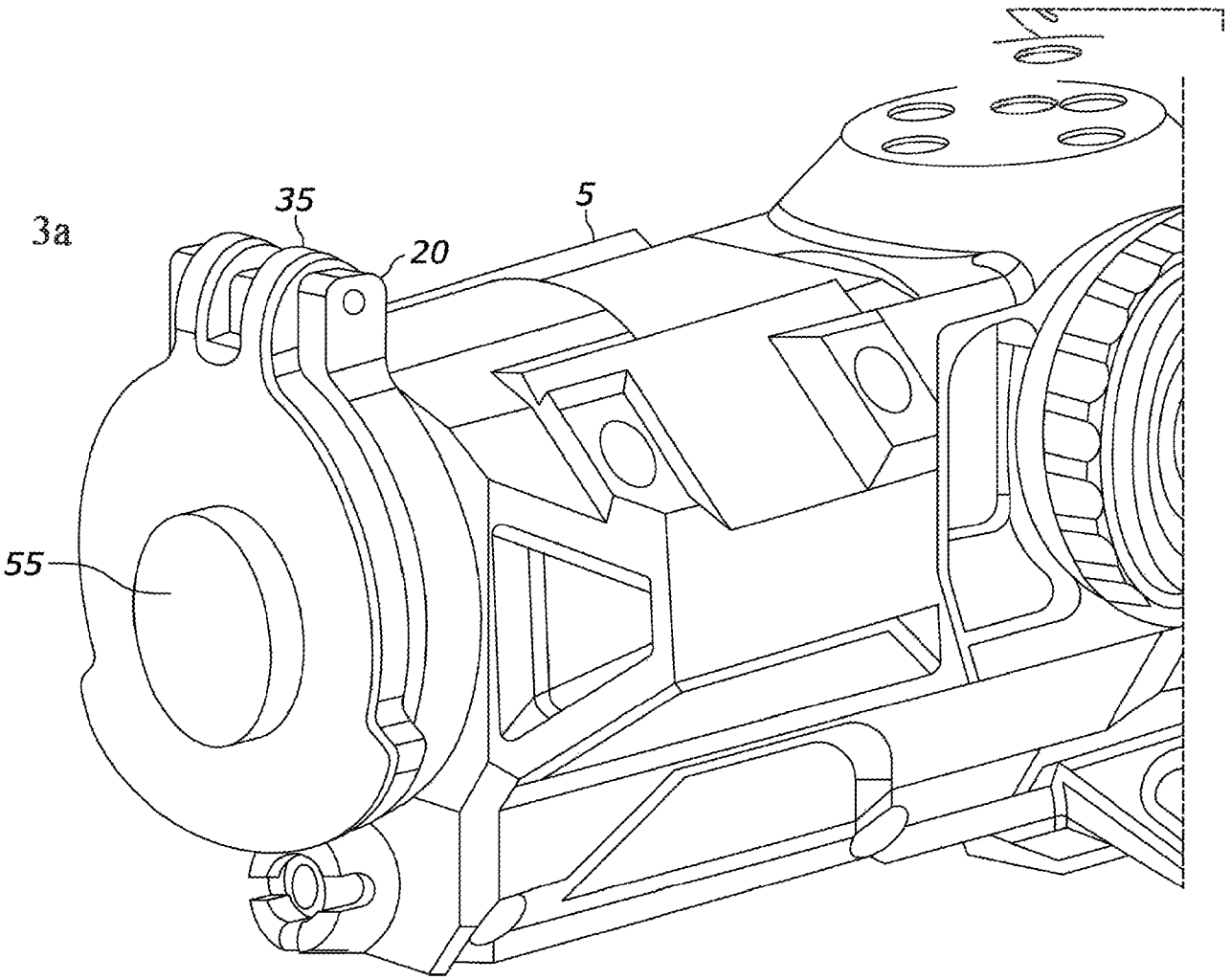
FIG. 5 is a representative depiction of a zero cap in a protective position.

FIG. 5 illustrates the zero cap 2 (from FIG. 2) in use in a protective position 3*a*. The zero cap 2 is fully connected, as illustrated in FIG. 2. The base 20 is connected to the riflescope 5. The aperture cap 35 is hingedly connected to the base 20. In one embodiment, the cap plug 55 is connected to the aperture cap 35 in such a manner that does not leave any holes on the aperture cap 35 exposed and open. In this position, the zero cap 2 is serving its protective function.

Figure 6:
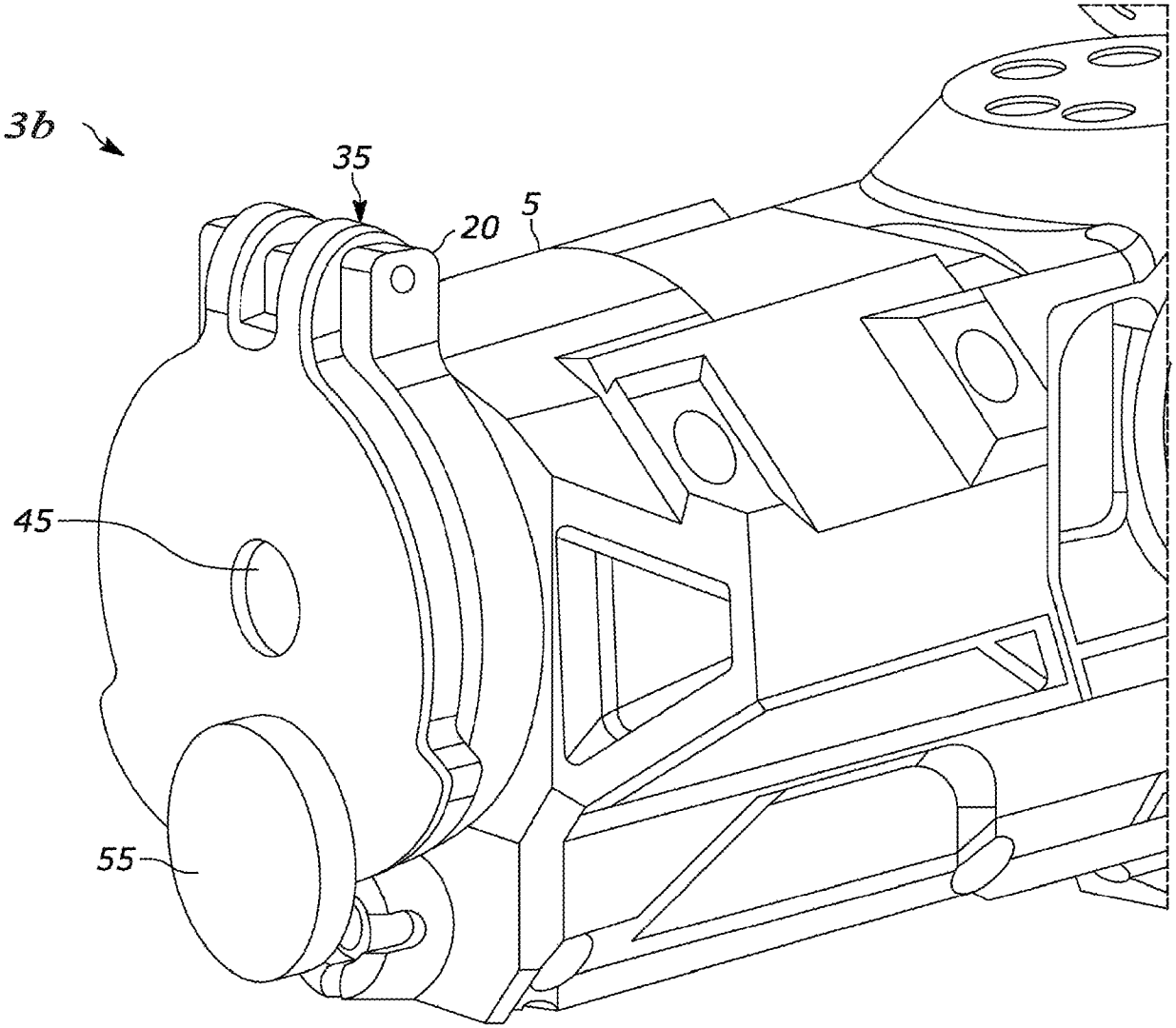
FIG. 6 is a representative depiction of a zero cap in a zero position.

FIG. 6 illustrates the zero cap 2 (from FIG. 2) in use in a zero position 3*b*. The zero cap 2 is fully connected, as illustrated in FIG. 2. The base 20 is connected to the riflescope 5. The aperture cap 35 is hingedly connected to the base 20. In one embodiment, the cap plug 55 is connected to the aperture cap 35 in such a manner that leaves the top hole 45 of the aperture cap 35 open. In this position, the zero cap 2 is serving its alignment function.

Figure 7:
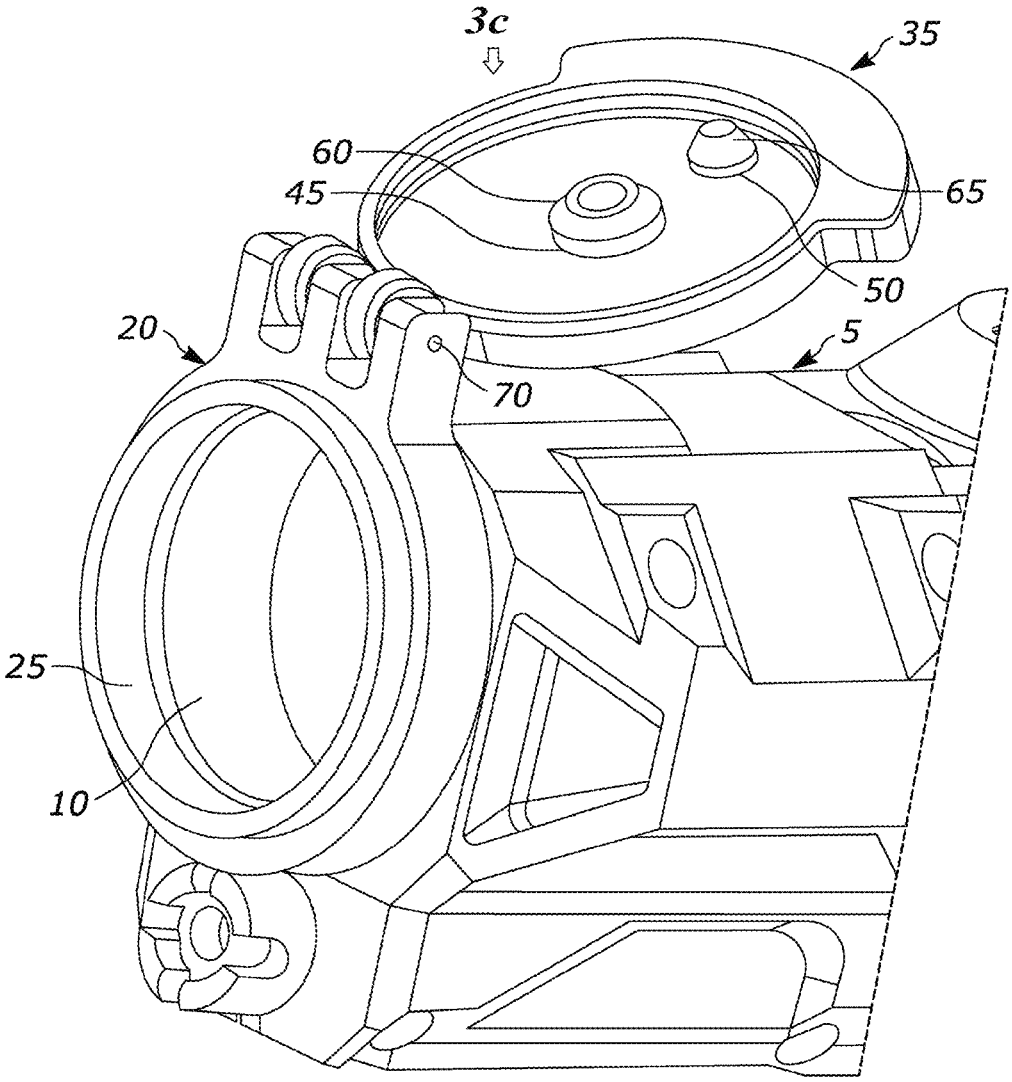
FIG. 7 is a representative depiction of a zero cap in an open position.

FIG. 7 illustrates the zero cap 2 (from FIG. 2) in use in an open position 3*c*. The zero cap 2 is fully connected but is not in fully closed as shown in FIG. 2. The base 20 is connected to the riflescope 5. The aperture cap 35 is hingedly connected to the base 20. In one embodiment, and as illustrated here, the aperture cap 35 has rotated about the hinge pin 70 in such a way to leave the opening 25 of the base 20 and the opening 10 of the riflescope 5 fully accessible and open. The cap plug 55, not fully shown here, is connected to the aperture cap 25. In one embodiment, the top plug 60 is fully integrated with the top hole 45 of the aperture cap 25, and the bottom plug 65 is fully integrated with the bottom hole 50 of the aperture cap 25. In this position, the zero cap 2 is serving its open function, and a firearm may be fired.

Cover for an Optic with Non-Circular Viewing Window

In one embodiment, the disclosure relates to a cover or protective device for a non-circular optic. In one embodiment, the cover for the non-circular optic can be installed and removed without the use of tools.

In one embodiment, the disclosure relates to a cover or protective device for a device with a viewing window. In one embodiment, the cover for the device can be installed and removed without the use of tools.

In one embodiment, the disclosure relates to a cover or protective device for an enabler comprising: a frame or structure with one or more holes that slide over one or more mounting studs of an enabler with a viewing window, and a protective material configured to cover the viewing window of the enabler. In one embodiment, the cover or protective device further comprises a connector coupling the frame or structure to the protective material.

In one embodiment, the disclosure relates to a system comprising: an enabler for a viewing optic, the enabler having a window and a window frame that surrounds at least a portion of the window, the window frame having one or more mounting studs, and a cover having a frame or structure with one or more holes that slide over the one or more mounting studs of the window frame, a protective material configured to cover the window of the enabler, when desired by the user, and connector coupling the frame or structure to a protective material. In one embodiment, the protective material can flip into the window frame of the enabler when desired by the user.

In one embodiment, the disclosure relates to a cover having a semi malleable frame that slides over tapered retaining studs on the frame surrounding the viewing window of the optic or device or enabler. The cover can be easily removed as it can slide back over the head of the stud due to the malleable nature of the cover.

In one embodiment, the cover is made of a pliable material.

In one embodiment, the window frame has 4, 6, 8, or 10 mounting studs. In on embodiment, the window frame has an even number of mounting studs. In another embodiment, the window frame has an odd number of mounting studs.

In one embodiment, the optic cover disclosed herein can be used with a viewing optic, including but not limited to, a viewing optic with an integrated display system, a Smart Scope, a traditional riflescope, a red dot, a holographic sight, an aiming laser device, a thermal imager or another non-circular shaped lens housing. The cover disclosed herein could be incorporated into cameras, phone cases, or any other device that would benefit from a protective cover that could be readily replaced by the end user.

Figure 8:
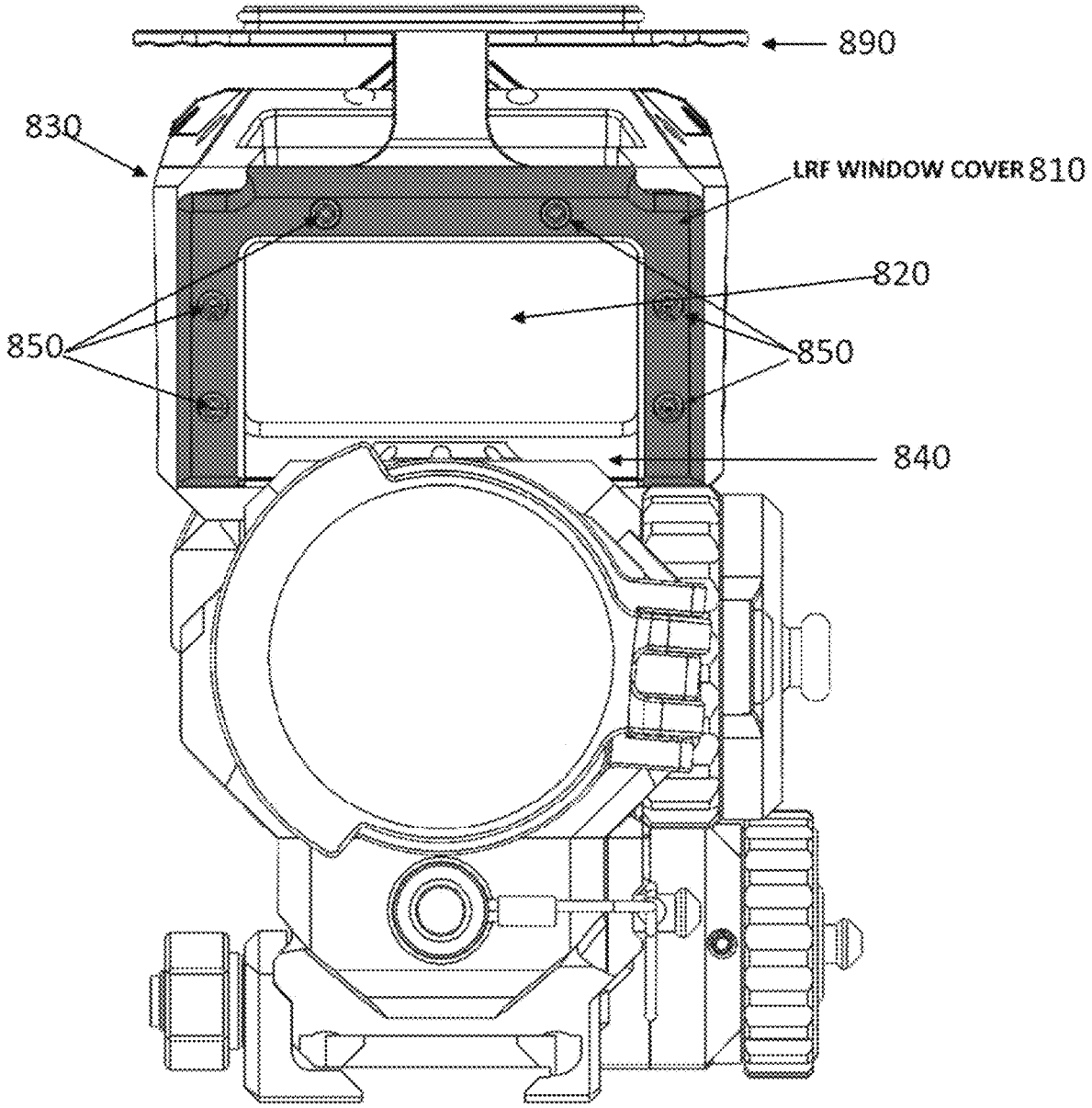
FIG. 8 is a representative depiction of a view of a cover or protective device for an optic having a non-circular viewing window, wherein the optic is shown as a laser rangefinder with a square shaped viewing window.
Figure 9:
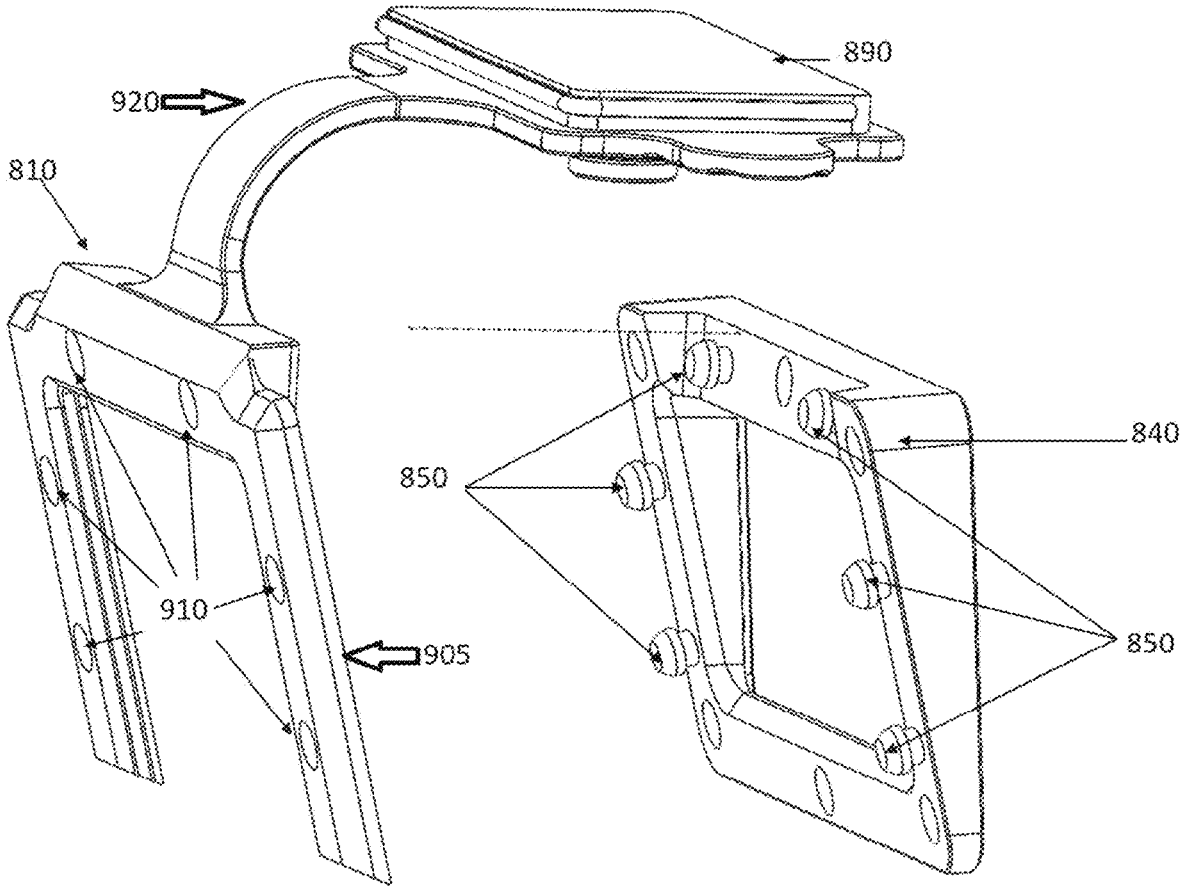
FIG. 9 is a representative depiction showing the frame of the non-circular optic surrounding the viewing window with multiple holding studs and the cover or protective device having a frame with corresponding holes to slide over the holding studs and a protective material to cover the viewing window.

FIGS. 8 and 9 provide representative, non-limiting depictions of a cover for the window of a non-circular optic. In this representative example, a laser rangefinder enabler with a square viewing window is shown. The cover (810) has a protective material that protects the viewing window (820) of the range finding enabler (830).

In one embodiment, the range finding enabler (830) has a frame (840) in the front that holds the window (820) in place. The frame (840) has six mounting studs (850) that have a 60° tapered head on the front of the stud and a shelf at the rear of the stud that prevents the cover (810) from moving when the user doesn't intend for it to move.

In one embodiment, the cover or protective device (810) has a frame (905) with six corresponding holes (910) that slide over the mounting stud (850) on the window frame of the enabler. The cover (810) has a connector (920) that couples the frame (905) to a protective material (890).

The cover or protective device (810) has a flap or protective material (890) that flips into the window frame (840), which protects the viewing window (820) when employed. The flap or protective material (890) can be stored on top of the range finding enabler (830) when the user wants to the use the range finder.

Figure 10:
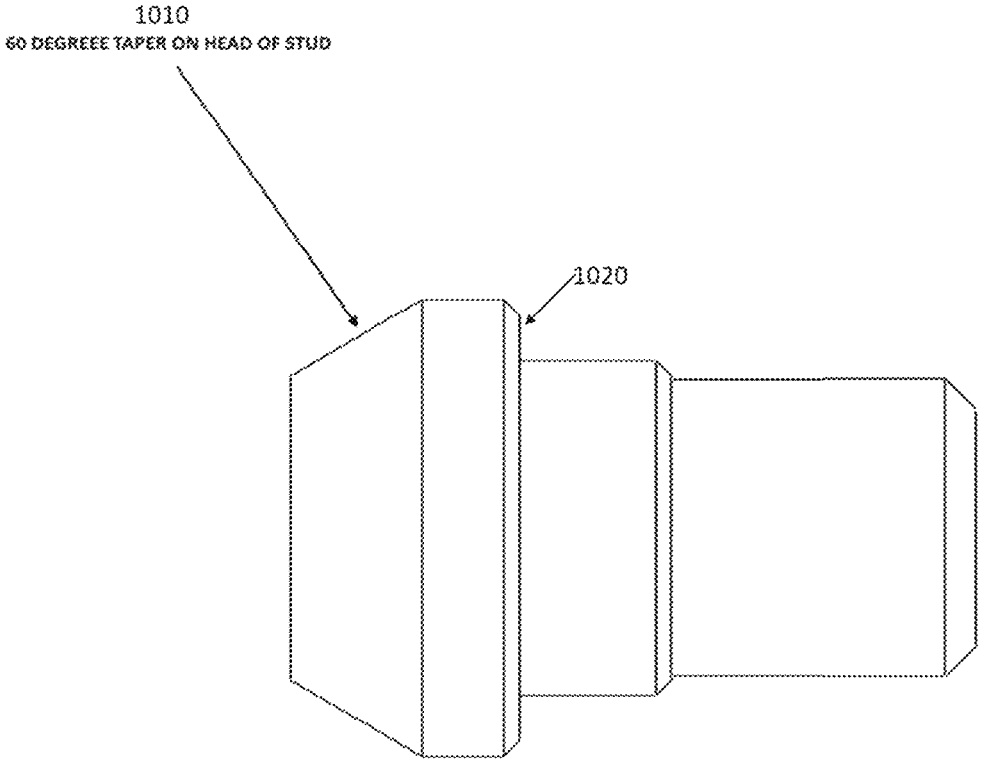
FIG. 10 is a representative depiction of a holding stud with a 60° tapered head.

FIG. 10 is a representative depiction of the mounting stud with a 60° tapered head (1010). The semi malleable nature of the cover (810) ensures it can easily slip over the head of the stud (1010) and still pop over the shelf of the of stud (1020) when deliberate force is applied. This allows users to press the cover (810) on and peel it off as needed.

Figure 11:
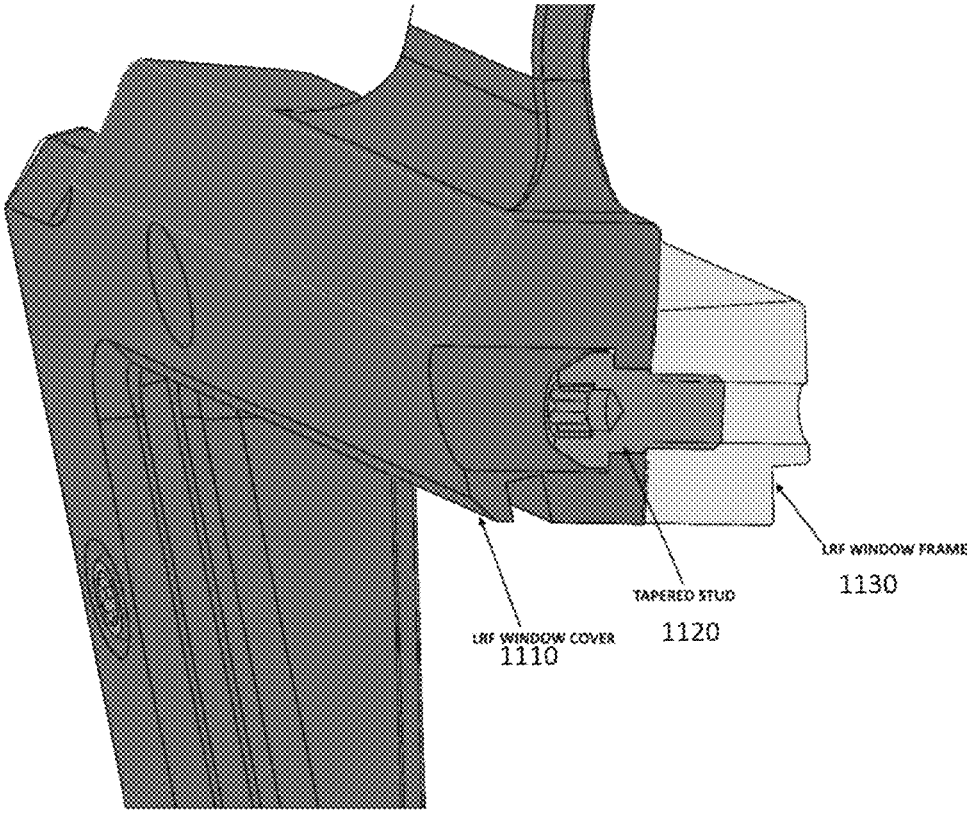
FIG. 11 is a representative depiction of the interaction between the frame of the protective device or cover, the holding or mounting stud on the window frame surrounding the viewing window of an enabler.

FIG. 11 is a representative, non-limiting depiction of the cover 1110, the window frame of the laser rangefinder 1130, and the holding or mounting stud 1120, which is located on the window frame.

In one embodiment, the frame of the viewing optic can any number of holding or mounting studs including but not limited to 1, 2 3, 4, 5, 6, 7, 8, 9, 10, 11, 12, 13, 14, 15, 16, 17, 18, 19, 20, and greater than 20 holding studs. In one embodiment, the frame of the optic has at least 6 holding or mounting studs. In another embodiment, the frame of the optic has no more than 12 holding or mounting studs.

In one embodiment, the cover has a corresponding number of holes to match the number of holding studs on the window frame surrounding the viewing window of the enabler. In one embodiment, the cover has 1, 2 3, 4, 5, 6, 7, 8, 9, 10, 11, 12, 13, 14, 15, 16, 17, 18, 19, 20, and greater than 20 holes. In one embodiment, the cover has at least 6 holes. In another embodiment, the cover has no more than 12 holes.

In another embodiment, the holding or mounting studs can be located in different positions or orientations. In another embodiment, the holding or mounting studs, and the associated cover, could wrap around a corner.

In one embodiment, the holding or mounting studs are integrated directly into the frame. The holding studs are machined directly into the frame, simplifying the assembly. In another embodiment, the holding or mounting studs are separately manufactured and then coupled to the window frame of the enabler.

In another embodiment, holding studs can be incorporated into the cover and the holes incorporated into the frame.

In one embodiment, the cover does a protective material that does not flip onto the enabler. In this embodiment, the cover is fully removed any time the user wants the window open. In another embodiment, the flip cover is rotated a different direction other than to the top of the enabler.

In one embodiment, the same mounting or hold stud and hole method can be used to retain the flip cap or protective material in an open and/or closed position. In this embodiment, the top of the enabler could have mounting or holding studs and the protective material can have holes configured to slide over the mounting or holding studs.

In another embodiment, the cover may have a finger tab to facilitate easy removal of the cover from the viewing optic.

Figure 12A:
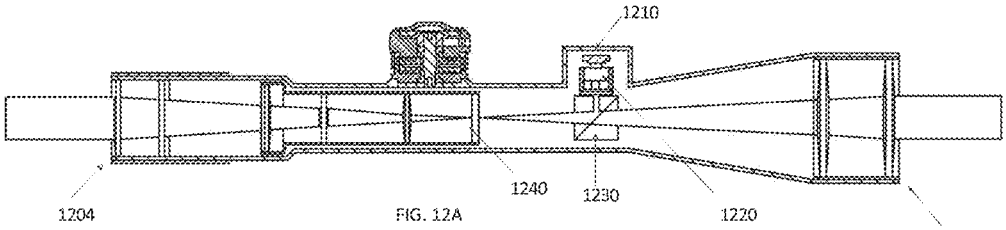
FIGS. 12A-12C are representative depictions of a viewing optic having an active display, which is one representative type of a viewing optic that can be used with an enabler and a protective cap disclosed herein.
Figure 12B:
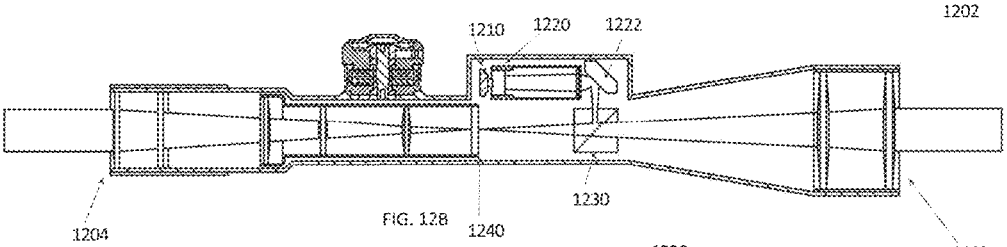
Figure 12C:
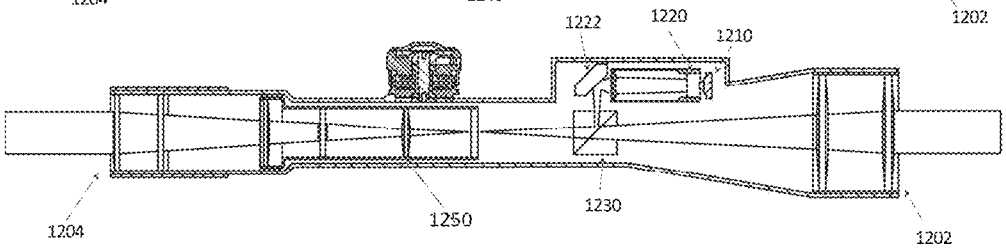

In another embodiment, the tapers on the front and back of the holding studs could vary angles and shapes, and could be steeper or shallower than shown. In one embodiment, the holding stud has a 40°, 45°, 50°, 55°, 60°, 65°, 70°, 75°, 80°, 85°, 90°, 95°, 100°, 110°, 120°, or greater than 120° tapered head. In one embodiment, the holding stud has from a 30° to a 150° tapered head. In one embodiment, the holding stud has from a 50° to a 75° tapered head. In still another embodiment, the holding stud has from a 60° to a 110° tapered head FIGS. 12A-12C are representative depictions of a viewing optic for which the cover disclosed herein may be used. The viewing optic has a main body with an ocular lens system 1204 at one end of the main body and an objective lens system 1202 at the other end of the main body.

In one embodiment, the viewing optic has an optical system comprised of an objective lens system that focuses an image from a target down to a first focal plane (hereafter referred to as the "FFP Target Image"), followed by an erector lens system that inverts the FFP Target Image and focuses it to a second focal plane (hereafter referred to as the "SFP Target Image"), an eyepiece lens system that collimates the SFP Target Image so that it can be observed by the human eye.

In one embodiment, a laser rangefinder is coupled to the body of the viewing optic.

In one embodiment, the viewing optic has an active display 1210 for generating an image. In another embodiment, the viewing optic has a collector lens system 1220 to collect light from the active display. In still another embodiment, the viewing optic has a beam combiner 1230 to combine the image from the active display with an image of an outward scene. In another embodiment, the beam combiner 1230 is located between an objective lens system 1202 and a first focal plane 1240. The first focal plane 1240 is located between the erector lens system 1250 and the objective lens system 1202.

In another embodiment, the viewing optic has a reflective material 1222 to direct the generated image from the active display to the beam combiner.

Active Display

In one embodiment, the viewing optic has an active display 1210. In one embodiment, the active display is controlled by a microcontroller or computer. In one embodiment, the active display is controlled by a microcontroller with an integrated graphics controller to output video signals to the display. In one embodiment, information can be sent wirelessly or via a physical connection into the viewing optic via a cable port. In still another embodiment, numerous input sources can be input to the microcontroller and displayed on the active display.

In one embodiment, the active display can be a reflective, transmissive or an emissive micro-display including but not limited to a micro display, transmissive active matrix LCD display (AMLCD), Organic light-emitting diode (OLED) display, Light-Emitting Diode (LED) display, e-ink display, a plasma display, a segment display. an electroluminescent display, a surface conduction electron-emitter display, a quantum dot display, etc.

In one embodiment, the LED array is a micro-pixelated LED array and the LED elements are micro-pixelated LEDs (also referred to as micro-LEDs or μLEDs in the description) having a small pixel size generally less than 75 μm. In some embodiments, the LED elements may each have a pixel size ranging from approximately 8 μm to approximately 25 μm, and have a pixel pitch (both vertically and horizontally on the micro-LED array) ranging from approximately 10 μm to approximately 30 μm. In one embodiment, the micro-LED elements have a uniform pixel size of approximately 14 μm (e.g., all micro-LED elements are the same size within a small tolerance) and are arranged in the micro-LED array with a uniform pixel pitch of approximately 25 μm. In some embodiments, the LED elements may each have a pixel size of 25 μm or less and a pixel pitch of approximately 30 μm or less.

In some embodiments, the micro-LEDs may be inorganic and based on gallium nitride light emitting diodes (GaN LEDs). The micro-LED arrays (comprising numerous μLEDs arranged in a grid or other array) may provide a high-density, emissive micro-display that is not based on external switching or filtering systems. In some embodiments, the GaN-based, micro-LED array may be grown on, bonded on, or otherwise formed on a transparent sapphire substrate.

In one embodiment, the sapphire substrate is textured, etched, or otherwise patterned to increase the internal quantum efficiency and light extraction efficiency (i.e., to extract more light from the surface of the micro-LEDs) of the micro-LEDs. In other embodiments, silver nanoparticles may be deposited/dispersed on the patterned sapphire substrate to coat the substrate prior to bonding the micro-LEDs to further improve the light efficiency and output power of the GaN-based micro-LEDs and of the micro-LED array.

In one embodiment, the active display can be monochrome or can provide full color, and in some embodiments, can provide multi-color. In other embodiments, other suitable designs or types of displays can be employed. The active display can be driven by electronics. In one embodiment, the electronics can provide display functions, or can receive such functions from another device in communication therewith.

In one embodiment, the active display can be part of a backlight/display assembly, module or arrangement, having a backlight assembly including a backlight illumination or light source, device, apparatus or member, such as an LED backlight for illuminating the active display with light. In some embodiments, the backlight source can be a large area LED and can include a first or an integrated lens for collecting and directing generated light to a second, illumination or condenser lens, for collecting, concentrating and directing the light onto active display, along display optical axis B, with good spatial and angular uniformity. The backlight assembly and the active display are able to provide images with sufficient high brightness luminance to be simultaneously viewed with a very high brightness real world view through optics, while being at low power.

The backlight color can be selected to be any monochrome color, or can be white to support a full color microdisplay. Other backlight design elements can be included, such as other light sources, waveguides, diffusers, micro-optics, polarizers, birefringent components, optical coatings and reflectors for optimizing performance of the backlight, and which are compatible with the overall size requirements of the active display, and the luminance, power and contrast needs.

Representative examples of micro displays that can be used include but are not limited to: Microoled, including MDP01 (series) DPYM, MDP02, and MDP05; Emagin such as the SVGA, micro-displays with pixel pitches are 9.9×9.9 micron and 7.8×7.8 micron, and Lightning Oled Microdisplay, such as those produced by Kopin Corporation. Micro LED displays can also be used including but not limited to those produced by VueReal and Lumiode.

In one embodiment, the electronics working with the active display can include the ability to generate display symbols, format output for the display, and include battery information, power conditioning circuitry, video interface, serial interface and control features. Other features can be included for additional or different functionality of the display overlay unit. The electronics can provide display functions, or can receive such functions from another device in communication therewith.

In one embodiment, the active display can generate images including but not limited to text, alpha-numeric, graphics, symbols, and/or video imagery, icons, etc., including active target reticles, range measurements and wind information, GPS and compass information, firearm inclination information, target finding, recognition and identification (ID) information, and/or external sensor information (sensor video and/or graphic s), or images for situational awareness, for viewing through the eyepiece along with the images of the view seen through optics. The direct viewing optics can include or maintain an etched reticle and bore sight, and retain high resolution.

In one embodiment, the utilization of an active display allows for a programmable electronic aiming point to be displayed at any location in the field of view. This location could be determined by the user (as in the case of a rifle that fires both supersonic and subsonic ammo and thus has two different trajectories and "zeros"), or could be calculated based upon information received from a ballistic calculator. This would provide a "drop compensated" aiming point for long range shooting that could be updated on a shot to shot interval.

In one embodiment, the active display can be oriented to achieve maximum vertical compensation. In one embodiment, the active display is positioned to be taller than it is wide.

In one embodiment, the viewing optic further comprises a processor in electronic communication with the active display.

In another embodiment, the viewing optic relay include memory, at least one sensor, and/or an electronic communication device in electronic communication with the processor.

Beam Combiner

In one embodiment, the viewing optic has a beam combiner 1230. In one embodiment, the beam combiner is one or more prismatic lenses (the prismatic lenses constitute the beam combiner). In another embodiment, the main body of the riflescope has a beam combiner that combines images generated from an active display with images generated from the viewing optics along the viewing optical axis of the riflescope.

In one embodiment, a beam combiner is used to combine a generated image from an integrated display system with an image from an optical system for viewing an outward image, wherein the optical system is located in a main body of a riflescope, in front of a first focal plane in the main body, and then the combined image is focused onto the first focal plane, such that the generated image and the viewed image did not move in relation to one another. With the combined image focused onto the first focal plane, an aiming reference generated by the integrated display system will be accurate regardless of adjustments to the movable erector system.

In one embodiment, a beam combiner can be aligned with the integrated display system along the display optical axis, and positioned along the viewing optical axis of the viewing optics of the main body of a riflescope, thereby allowing for the images from the integrated display to be directed onto the viewing optical axis for combining with the field of view of the viewing optics in an overlaid manner.

In another embodiment, the beam combiner and the integrated display system are in the same housing. In one embodiment, the beam combiner is approximately 25 mm from the objective assembly.

In one embodiment, the beam combiner is approximately 5 mm distance from the objective assembly. In one embodiment the beam combiner is positioned at a distance from the objective assembly including but not limited to from 1 mm to 5 mm, or from 5 mm to 10 mm or from 5 mm to 15 mm, or from 5 mm to 20 mm, or from 5 mm to 30 mm, or from 5 mm to 40 mm or from 5 to 50 mm.

In yet another embodiment, the beam combiner is positioned at a distance from the objective assembly including but not limited to from 1 mm to 4 mm, or from 1 mm to 3 mm, or from 1 mm to 2 mm.

In one embodiment, the beam combiner is positioned at a distance from the objective assembly including but not limited to at least 3 mm, at least 5 mm, at least 10 mm, and at least 20 mm. In yet another embodiment, the beam combiner is positioned at a distance from the objective assembly from 3 mm to 10 mm.

In another embodiment, the beam combiner is approximately 150 mm distance from the ocular assembly. In one embodiment the beam combiner is positioned at a distance from the ocular assembly including but not limited to from 100 mm to 200 mm or from 125 mm to 200 mm or from 150 mm to 200 mm or from 175 mm to 200 mm.

In one embodiment the beam combiner is positioned at a distance from the ocular assembly including but not limited to from 100 mm to 175 mm or from 100 mm to 150 mm or from 100 mm to 125 mm.

In one embodiment the beam combiner is positioned at a distance from the ocular assembly including but not limited to from 135 mm to 165 mm or from 135 mm to 160 mm or from 135 mm to 155 mm or from 135 mm to 150 mm or from 135 mm to 145 mm or from 135 mm to 140 mm.

In one embodiment the beam combiner is positioned at a distance from the ocular assembly including but not limited to from 140 mm to 165 mm or from 145 mm to 165 mm or from 150 mm to 165 mm or from 155 mm to 165 mm or from 160 mm to 165 mm.

In one embodiment the beam combiner is positioned at a distance from the ocular assembly including but not limited to at least 140 mm or at least 145 mm or at least 150 mm or at least 155 mm.

In still another embodiment, the viewing optic has a beam combiner, wherein the beam combiner is located beneath the elevation turret on the outside center part of the scope body.

In one embodiment, the beam combiner can have a partially reflecting coating or surface that reflects and redirects the output or at least a portion of the active display output from the integrated display system onto the viewing axis to the viewer's eye at eyepiece while still providing good transmissive see-through qualities for the direct viewing optics path.

In one embodiment, the beam combiner can be a cube made of optical material, such as optical glass or plastic materials with a partially reflective coating. The coating can be a uniform and neutral color reflective coating, or can be tailored with polarizing, spectrally selective or patterned coatings to optimize both the transmission and reflection properties in the eyepiece. The polarization and/or color of the coating can be matched to the active display. This can optimize reflectance and efficiency of the display optical path with minimal impact to the direct viewing optics transmission path.

Although the beam combiner is shown as a cube, in some embodiments, the beam combiner can have different optical path lengths for the integrated display system, and the direct viewing optics along viewing optical axis A. In some embodiments, the beam combiner can be of a plate form, where a thin reflective/transmissive plate can be inserted in the direct viewing optics path across the optical axis A.

In one embodiment, the position of the beam combiner can be adjusted in relation to the reflective material to eliminate any errors, including but not limited to parallax error. The position of the beam combiner can adjusted using a screw system, a wedge system or any other suitable mechanism.

In one embodiment, the position of the beam combiner can be adjusted in relation to the erector tube to eliminate any errors, including but not limited to parallax error.

Collector Lens System

In one embodiment, viewing optic can have a collector lens system 1220 to collect light from the active display. In one embodiment, the viewing has an optical system based upon the use of optical lenses as a part of one or more lens cells, which include the lens itself and a lens cell body to which the lens is mounted. In one embodiment, the lens cell includes a precision formed body that is generally cylindrical or disc shaped. This body has a central aperture for mounting the lens in alignment with an optical axis of a larger optical system. The cell body can also be said to have its own alignment axis, which will ultimately be aligned with the optical axis for the larger system when the lens cell is mounted therein. In addition, the lens cell serves as a "holder" for the lens, serves as a mechanism by which the lens can be mounted to and in the larger optical system, and (finally) serves as a means by which the lens can be manipulated by and for the purposes of that system.

In one embodiment, the integrated display system comprises a collector lens system, also referred to as a lens system. In one embodiment, the collector lens system comprises an inner lens cell and an outer lens cell.

Reflective Material

In one embodiment, the viewing optic comprises a reflective material 1222. In one embodiment, the reflective material 1222 is a mirror. In one embodiment, the viewing optic comprises one or more mirrors. In one embodiment, the integrated display system comprises two, three, four or more mirrors.

In one embodiment, the minor is positioned at an angle from 30° to 60°, or from to 55°, 30° to 50°, or from 30° to 45°, or from 30° to 40°, or from 30° to 35° relative to the emitted light of the display.

In one embodiment, the minor is positioned at an angle from 30° to 60°, or from to 60°, 40° to 60°, or from 45° to 60°, or from 50° to 60°, or from 55° to 60° relative to the emitted light of the display.

In one embodiment, the mirror is positioned at an angle of at least 40°. In one embodiment, the mirror is positioned at an angle of 45° relative to the emitted light of the display.

In one embodiment, the position of the mirror can be adjusted in relation to the beam combiner to eliminate any errors, including but not limited to parallax error.

In one embodiment, the position of the mirror can be adjusted in relation to the active display to eliminate any errors, including but not limited to parallax error.

In one embodiment, the display for generating digital images are injected into the first focal plane of the main body, such that the digital image in the first focal plane is not tied to the movement of the erector tube.

In one embodiment, the active display is configured to emit light in a direction that is substantially parallel to an optical axis of the viewing scope.

In one embodiment, the active display is configured to emit light in a direction that is substantially perpendicular to an optical axis of the viewing scope.

In one embodiment, the mirror is oriented at an angle of approximately 45° relative to the emitted light of the display.

In one embodiment, the display and the mirror are located on a common side of the viewing optic main body.

In one embodiment, the display and the mirror are located on opposite sides of the viewing optic main body.

All publications and patents mentioned in the above specification are herein incorporated by reference. Various modifications and variations of the described compositions and methods of the invention will be apparent to those skilled in the art without departing from the scope and spirit of the invention. One skilled in the art will recognize at once that it would be possible to construct the present invention from a variety of materials and in a variety of different ways. Although the invention has been described in connection with specific preferred embodiments, it should be understood that the invention should not be unduly limited to such specific embodiments. While the preferred embodiments have been described in detail, and shown in the accompanying drawings, it will be evident that various further modification are possible without departing from the scope of the invention as set forth in the appended claims. Indeed, various modifications of the described modes for carrying out the invention which are obvious to those skilled in marksmanship, computers or related fields are intended to be within the scope of the following claims.

What is claimed is:

1. A system comprising: a laser rangefinder for a viewing optic, the laser rangefinder having a viewing window and a window frame that surrounds at least a portion of the viewing window, the window frame having one or more mounting studs, and a cover having a frame with one or more holes configured to slide over the one or more mounting studs of the window frame, a protective material configured to cover the viewing window of the laser rangefinder; and a connector coupling the frame to the protective material.

2. The system of claim 1, wherein the window frame has 4 or 6 or 8 mounting studs.

3. The system of claim 1, wherein the window frame has an even number of mounting studs.

4. The system of claim 1, wherein the window frame has 6 mounting studs.

5. The system of claim 1, wherein the cover is made of malleable material.

6. The system of claim 1, wherein the protective material is configured to fit the window frame of the enabler.

7. The system of claim 1, wherein the one or more mounting studs have a 60° tapered head on a front portion of the stud.

8. The system of claim 1, wherein the one or more mounting studs have a shelf at a rear portion of the stud.

9. The system of claim 1, wherein the laser rangefinder is coupled to a top portion of the viewing optic, the viewing optic having a main body with an objective lens system at a first end of the main body and an ocular lens system located at a second end of the main body.

10. The system of claim 9, wherein the viewing optic comprises an active display configured to generate an image.

11. The system of claim 10, wherein the generated image is projected into a first focal plane of the viewing optic, the first focal plane located between the objective lens system and an erector lens system.

12. A laser rangefinder comprising: a viewing window and a window frame that surrounds at least a portion of the viewing window, the window frame having one or more mounting studs.

13. A laser rangefinder of claim 12, wherein the one or more mounting studs have a 60° tapered head on a front portion of the stud.

14. A laser rangefinder of claim 13, wherein the one or more mounting studs have a shelf at a rear portion of the stud.

* * * * *